US007281961B1

(12) United States Patent
Sugiyama et al.

(10) Patent No.: US 7,281,961 B1
(45) Date of Patent: Oct. 16, 2007

(54) CONNECTOR

(75) Inventors: Osamu Sugiyama, Shizuoka (JP); Hitoshi Saito, Shizuoka (JP); Yasuhiro Ohkubo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/785,787

(22) Filed: Apr. 20, 2007

(30) Foreign Application Priority Data

May 12, 2006 (JP) ..... 2006-133556

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 5,618,207 A * 4/1997 Maejima ..... 439/595
5,722,857 A * 3/1998 Saito et al. ..... 439/595
5,746,624 A * 5/1998 Ohsumi et al. ..... 439/595
5,989,066 A * 11/1999 Cox ..... 439/595
6,551,145 B2 * 4/2003 Kurimoto et al. ..... 439/752
6,948,978 B2 * 9/2005 Itou et al. ..... 439/595
7,114,997 B2 * 10/2006 Sagawa et al. ..... 439/752
7,168,981 B2 * 1/2007 Takahashi ..... 439/595
2003/0157835 A1 * 8/2003 Ishikawa et al. ..... 439/595

FOREIGN PATENT DOCUMENTS

JP 10-312847 A 11/1998
JP 2001-185275 A 7/2001

* cited by examiner

*Primary Examiner*—Tho D. Ta
(74) *Attorney, Agent, or Firm*—Sughrue Mion Pllc.

(57) ABSTRACT

To positively retain terminal retaining members provisionally and completely relative to a connector housing, a connector 1, 41, 61 includes a connector housing 2, 42, 62 for receiving terminals 4, 64, and a holder 3, 43, 63 attached in a sliding manner to the connector housing. Terminal retaining members 9 are pivotally provided respectively at opening portions 7 of the connector housing. The holder includes first slanting portions 26 for pushing the terminal retaining members into the respective opening portions so as to provisionally retain the terminal retaining members, and second slanting portions 29 for further pushing the terminal retaining members into the opening portions so as to completely retain the terminal retaining members. When the retaining members are provisionally retained, a distal end of each retaining member abuts against the corresponding second slanting portion. The plurality of retaining members are provided, and the plurality of first slanting portions, as well the plurality of second slanting portions, are provided in corresponding relation to the plurality of retaining members, respectively.

7 Claims, 13 Drawing Sheets

CONNECTOR

BACKGROUND OF THE INVENTION

1. Field of the Invention

This invention relates to a connector in which terminals within a connector housing are retained by retaining lances and retaining members in a double manner, and the bending of the retaining lances are prevented by protruding portions of a front holder.

2. Description of the Related Art

FIG. 15 shows one conventional connector (see Patent Literature).

This connector 81 comprises a connector housing 82 made of a synthetic resin, and terminals 100 (each having a wire connected thereto) inserted in respective terminal receiving chambers 83 of the connector housing 82. Elastic lances 84 for primarily retaining purposes and retaining members 85 for secondarily retaining purposes are provided at the connector housing 82, and each retaining member 85 is provided so as to be pivotally moved about a hinge formed at a rear end thereof.

The retaining member 85 has a provisionally-retaining step portion 87 and a completely-retaining step portion 88 for an opening portion 86 in the connector housing 82. In a provisionally-retained condition of the retaining member 85 shown in FIG. 15, each terminal 100 is inserted into the terminal receiving chamber 83 through a rear opening 83*a*, and is primarily retained by the retaining lance 84, and then when the retaining member 85 is pushed into the connector housing 82, a step portion 102 of the terminal 100 is retained in a secondary manner by a front end surface of the retaining member 85.

In FIG. 15, although only the upper terminal receiving chambers 83 are shown, terminal receiving chambers are also provided in a lower portion of the connector housing, and these lower terminal receiving chambers are arranged in staggered and inverted relation to the upper terminal receiving chambers 83. In FIG. 15, reference numeral 89 denotes a partition wall between the adjacent lower terminal receiving chambers. Terminals 100 received respectively in the lower terminal receiving chambers are retained in a double manner by the lower retaining member 85 similar to the upper retaining member 85.

FIG. 16 shows another conventional connector (see Patent Literature 2).

This connector 91 comprises a synthetic resin-made connector housing 92, a synthetic resin-made front holder 93 attached to a front portion of the connector housing 92, and female terminals 95 (each having a wire connected thereto) inserted in respective terminal receiving chambers 94 of the connector housing 92.

The connector housing 92 has terminal retaining lances 96, and the front holder 93 has plate-like protruding portions 98 for insertion into respective bending space 97 for the retaining lances 96.

In a condition (provisionally-retained condition) in which the front holder 93 is slightly withdrawn forward from the connector housing 92, each terminal 95 is inserted into the terminal receiving chamber 94, and is retained by the retaining lance 96. Then, when the front holder 93 is pushed, each protruding portion 98 enters the corresponding bending space 97 for the retaining lance 96 to prevent the bending of the retaining lance 96, thereby enhancing a terminal retaining force (that is, achieving the double retaining of the terminal).

If any of the terminals 95 is incompletely inserted, the corresponding retaining lance 96 is kept in a bent condition, and the protruding portion 98 abuts against this retaining lance 96, and therefore the front holder 93 can not pushed any further, so that the abnormal insertion of the terminal is detected.

Patent Literature 1: JP-A-10-312847 (FIG. 7)

Patent Literature 2: JP-A-2001-185275(FIG. 7)

However, in the conventional connector 81 of FIG. 15, the upper and lower terminals inserted in the connector housing and primarily retained by the respective retaining lances 84 must be retained in a secondary manner by pushing the upper and lower retaining members 85 one by one into the connector housing, and therefore there has been encountered a problem that much time and labor are required for the secondary retaining of the terminals. And besides, there has been a fear that the worker may forget to push part of the retaining members 85 for secondarily retaining purposes. It is feared that this problem arises particularly in the case where a plurality of retaining members 85 are provided at the upper side or the lower side of the connector housing 82. Furthermore, even if there is provided only one retaining member 85, there has been a fear that the provisionally-retaining operation or the completely-retaining operation for the retaining member 85 may sometimes be incomplete, since the worker manually pushes the retaining member 85 into the connector housing.

Furthermore, when the two retaining step portions 87 and 88 of the retaining member 85 are subjected to wear, etc., as a result of repeating the retaining operation, there have been fears that the retaining member 85 may fail to be provisionally retained but may be completely retained, thus lowering the efficiency of the terminal inserting operation and that a click feel obtained upon provisional retaining or completely retaining of the retaining member 85 may be lowered.

In the case where different kinds (in size and shape) of terminals are to be received in one connector housing, the positions of the retaining lances 84 are offset in the longitudinal direction of the terminals, so that the retaining member 85 can not be properly disposed. Also, even in the case the terminals of the same kind are used such that the terminals in the upper terminal receiving chambers 83 and the terminals in the lower terminal receiving chambers are not inverted relative to each other, but are disposed in the same posture, there has been encountered a problem that the retaining members 85 can not be properly disposed, so that the double retaining of the terminals can not be effected.

SUMMARY OF THE INVENTION

With the foregoing in view, it is an object of this invention to provide a connector in which terminal retaining members can be positively retained provisionally and completely relative to a connector housing without any operation mistake, and besides the plurality of retaining members can be retained at the same time, and furthermore a click feel obtained when effecting a primary retaining operation and a secondary retaining operation for terminals, as well as a certainty of these operations, is enhanced, and furthermore each terminal can be positively retained with a high retaining force even in the cases where different kinds of terminals are used and where the terminals are received in the same posture.

The above object has been achieved by a connector of the invention of claim 1 characterized in that the connector comprises a connector housing for receiving terminals, and a holder attached in a sliding manner to the connector housing; and a terminal retaining member is pivotally provided at an opening portion of the connector housing; and the holder includes a first slanting portion for pushing the terminal retaining member into the opening portion so as to provisionally retain the terminal retaining member, and a second slanting portion for further pushing the terminal retaining member into the opening portion so as to completely retain the terminal retaining member.

In the above construction, when the holder is provisionally attached in a sliding manner to the connector housing, the first slanting portion primarily pushes the retaining member into the connector housing (The distal end of the retaining member slides along the first slanting portion, thus effecting the primary pushing-in of the retaining member), thereby provisionally retaining the retaining member relative to the connector housing. In this condition, the terminals are inserted into the connector housing. Then, the holder is further slid to be completely attached to the connector housing, and at the same time the second slanting portion further pushes the retaining member into the connector housing (The distal end of the retaining member slides along the second slanting portion, thus effecting the secondary pushing-in of the retaining member), thereby completely retaining the retaining member relative to the connector housing. In this condition, the terminals are positively retained by the retaining member, and are prevented from withdrawal.

The connector of the invention of claim 2, depending from claim 1, is characterized in that when the retaining member is provisionally retained, the distal end of the retaining member abuts against the second slanting portion.

In the above construction, when the worker provisionally attaches the holder to the connector housing in a sliding manner, the distal end of the retaining member slides past the first slanting portion to abut against the second slanting portion, and the worker can feel this abutting condition through the hand. In this condition, when the holder is further slidingly pushed in the attaching direction, the retaining member, while sliding along the second slanting portion, is further pushed into the connector housing, and retains the terminals. In the provisionally-retained condition of the retaining member, the distal end of the retaining member abuts against the second slanting portion, and therefore even when a small external force acts on the holder, the holder will not be shifted into the completely-retained condition.

The connector of the invention of claim 3, depending from claim 1, is characterized in that when the retaining member is provisionally retained, a wall of the holder is disposed in contact with an outer surface of the distal end portion of the retaining member.

In the above construction, the outer surface of the distal end portion of the retaining member is held in contact with the wall of the holder, and therefore in the provisionally-retained condition of the retaining member, the retaining member is prevented from projecting from the connector housing, so that the retaining member is positively kept in the provisionally-retained condition.

The connector of the invention of claim 4, depending from claim 1, is characterized in that the distal end portion of the retaining member is held between a wall of a connector housing and the wall of the holder.

In this construction, the completely-retained condition of the retaining member is firmly maintained, and even when an external force or the like acts on the connector, the retaining member is positively prevented from accidentally shifting from the completely-retained condition into the provisionally-retained condition.

The connector of the invention of claim 5, depending from claim 1, is characterized in that there are provided a plurality of the retaining members, and a plurality of first slanting portions, as well as a plurality of second slanting portions, are provided in corresponding relation to the plurality of retaining members, respectively.

In the above construction, the operations for provisionally retaining the plurality of retaining members, as well as the operations for completely retaining the plurality of retaining members, can be effected simultaneously by sliding the holder.

The connector of the invention of claim 6, depending from claim 1, is characterized in that the holder has protruding portions for insertion into respective bending spaces for terminal primarily-retaining lances provided within the connector housing.

In the above construction, when the holder is completely attached to the connector housing, the protruding portions prevent the bending of the retaining lances, and retain, together with the retaining member, the terminals in a triple manner, so that the terminal retaining force is markedly increased. If any of the terminals is incompletely inserted in the connector housing, the corresponding protruding portion abuts against the distal end of the bent retaining lance, and therefore the holder can not be completely attached to the connector housing, so that the abnormal insertion of the terminal is detected.

The connector of the invention of claim 7, depending from claim 1, is characterized in that another kind of terminals (other kind of terminals) are retained respectively by another kind of retaining lances (other kind of retaining lances) provided within the connector housing, and another kind of protruding portions (other kind of protruding portions) of the holder prevent the bending of the other kind of retaining lances.

In the above construction, when the holder is provisionally attached to the connector housing, the other kind of terminals within the connector housing are primarily retained respectively by the other kind of retaining lances, and when the holder is completely attached to the connector housing, the other kind of protruding portions are inserted respectively into bending spaces for the other kind of retaining lances, and prevent the bending of these retaining lances, thereby firmly retaining the other kind of terminals in a secondary manner.

In the invention of claim 1, by attaching the holder to the connector housing in a sliding manner, the retaining member for terminal retaining purposes can be positively retained provisionally and completely relative to the connector housing. Therefore, in contrast with the case where a retaining member is pushed into a connector housing by the fingers of the worker, there is no fear that the worker may fail and forget to effect the provisional retaining and the complete retaining, and the insertion of the terminals in the provisionally-retained condition, as well as the retaining of the terminals in the completely-retained condition, can be positively effected, so that the quality of the connector is enhanced.

In the invention of claim 2, when the distal end of the retaining member abuts against the second slanting portion, the worker can feel this abutting condition through the hand, and a click feel is obtained upon provisional retaining of the retaining member, and the retaining member can be positively provisionally retained. And besides, since the distal end of the retaining member abuts against the second slanting portion, the retaining member is prevented from being accidentally shifted into the completely-retained condition by interference with the exterior or the like, and the insertion of the terminals can be accurately effected in the provisionally-retained condition of the retaining member.

In the invention of claim 3, the provisionally-retained condition of the retaining member relative to the connector housing is maintained, and therefore the operation for inserting the terminals into the connector housing can be effected accurately.

In the invention of claim 4, the completely-retained condition of the retaining member relative to the connector housing is firmly maintained, and therefore the retained condition of the terminals is prevented from being accidentally canceled, and the reliability of the connection of the connector (the electrical connection of the terminals to mating terminals) is enhanced.

In the invention of claim 5, the operations for provisionally retaining the plurality of retaining members, as well as the operations for completely retaining the plurality of retaining members, can be effected simultaneously by sliding the holder. Therefore, as compared with the case where the worker pushes a plurality of retaining members into a connector housing with the hand so as to provisionally and completely retain the retaining members, the efficiency of the connector assembling operation is more enhanced, and also the time and labor required for the assembling operation are reduced.

In the invention of claim 6, the terminals are retained in a triple manner by the retaining lances, the protruding portions (for preventing the bending of these lances) and the retaining member, and the withdrawal of the terminals is positively prevented, and the reliability of the connection of the connector is enhanced. And besides, an improper insertion of any terminal in the connector housing is detected by the protruding portion, so that the reliability of the connection of the connector is further enhanced.

In the invention of claim 7, even in the case where another kind of terminals are received within the connector housing, these terminals are firmly retained by the corresponding retaining lances and the corresponding protruding portions of the holder, and therefore the reliability of the connection of the connector is enhanced.

DESCRIPTION OF THE PREFERRED EMBODIMENTS

FIGS. 1 to 4 show a first embodiment of a connector of the present invention.

Figure 1:
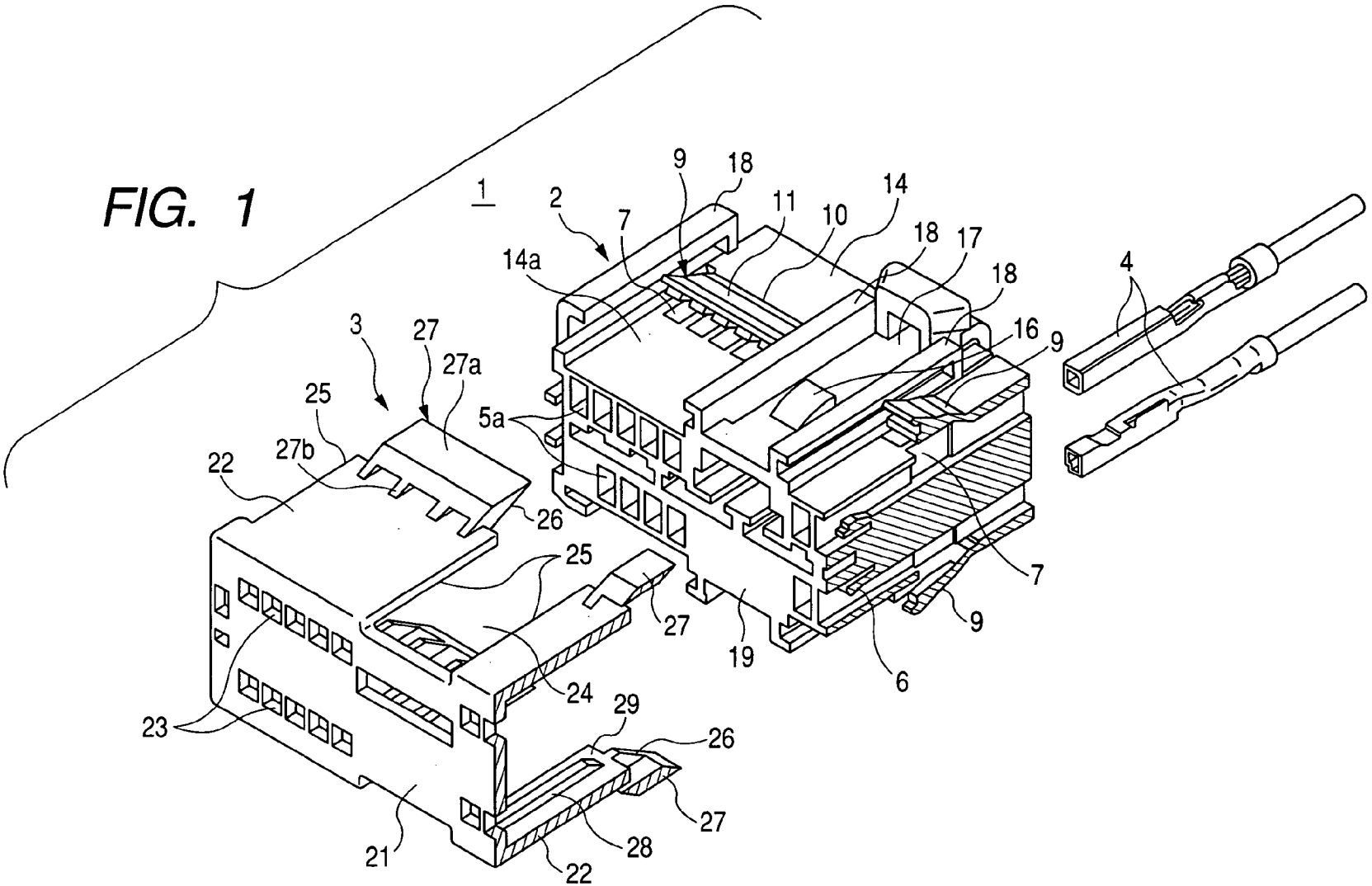
FIG. 1 is an exploded perspective view of a first embodiment of a connector of the present invention.
Figure 2:
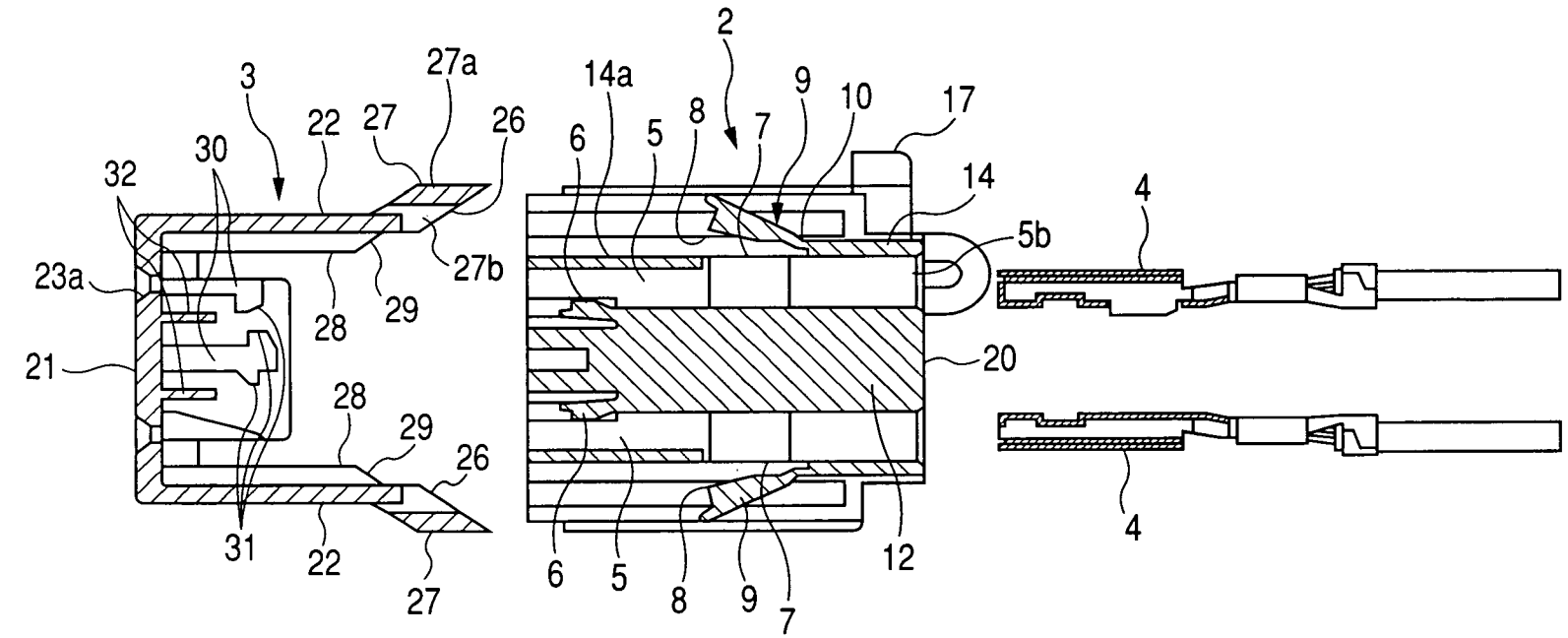
FIG. 2 is an exploded, vertical cross-sectional view of the connector.

As shown in FIGS. 1 and 2, this connector 1 comprises a synthetic resin-made connector housing 2, a synthetic resin-made front holder 3 attached to the connector housing 2 from a front side thereof toward a rear side thereof, and female terminals 4 (each having a wire connected thereto) inserted into the connector housing 2 from the rear side thereof.

The connector housing 2 has terminal receiving chambers 5 (FIG. 2) arranged in two (upper and lower) rows, and the female terminals 4 are received respectively in the upper and lower terminal receiving chambers 5 in such a manner that the upper female terminals 4 and the lower female terminals 4 are disposed symmetrically (that is, in generally back-to-back relation). First elastic arm-like terminal retaining lances 6 are provided respectively at front half portions of the upper and lower terminal receiving chambers 5 in such a manner that the upper retaining lances 6 and the lower retaining lances 6 are disposed symmetrically. Openings (opening portion) 7 are provided respectively at longitudinally-intermediate portions of the terminal receiving chambers 5. Generally plate-shaped terminal retaining members (hereinafter referred to merely as "retaining members") 9 each having a plurality of parallel projections 8 are connected to rear ends of the openings 7 through thin hinges 10 so as to be opened and closed.

The retaining member 9 includes a plate-like portion 11 (FIG. 1), the plurality of parallel projections 8 projecting from an inner surface of the plate-like portion 11, and the hinge 10 integrally connecting a rear end of the plate-like portion 11 to the connector housing 2 (The projections 8 can be called "second retaining lances".). The plurality of projections 8 can be replaced by one rib-like projecting portion continuous in the direction of the width of the connector.

The first retaining lance 6 is small in size, and the retaining lance 6 provided within each upper terminal receiving chamber 5 has an upwardly-directed projection **6*a* (FIG. 4) formed at a distal end portion thereof, and the retaining lance 6 provided within each lower terminal receiving chamber 5 has a downwardly-directed projection 6*a* formed at a distal end portion thereof. A front end surface of each projection 6*a* serves as a retaining surface. The upper retaining lances 6 as well as the lower retaining lances 6 are formed on and project obliquely forwardly from an intermediate partition wall 12 (FIG. 2) of the connector housing 2. A bending space 13 (FIG. 4) is formed between an outer surface of the partition wall 12 and each retaining lance 6**.

Each projection 8 of the retaining member 9 is larger in size than the first retaining lance 6. Each of the upper retaining members 9 has the downwardly-directed projections 8 formed at a distal end portion thereof, and each of the lower retaining members 9 has the upwardly-directed projections 8 formed at a distal (or front) end portion thereof. A front end surface of each projection 8 serves as a retaining surface. Each retaining member 9 in its free condition elastically projects obliquely forwardly from the hinge 10 (which serves as an axis of pivotal movement of the retaining member 9), and is disposed outwardly of the corresponding terminal receiving chambers 5.

In the present specification, the term "upward-downward direction" is used merely for description purposes, and does not always agree with the direction of the connector 1 in actual use. Here, the forward direction is defined as a connector fitting direction, and the rearward direction is defined as a connector disengaging direction.

Each upper retaining member 9 is continuous with a horizontal wall portion 14 (FIG. 2) which is a rear half portion of an upper wall of the connector housing 2. The plurality of openings 7 (FIG. 1) communicating with the respective terminal receiving chambers 5 are disposed beneath the upper retaining member 9, and are arranged parallel to one another. Also, the openings 7 are continuous at their front ends with a wall portion 14*a* (which is a front half portion of the upper wall of the connector housing 2), and the front half wall portion 14*a* is disposed at a level one step lower than the rear half wall portion 14. The lower retaining members 9, the lower openings 7 and lower front and rear wall portions 14 are disposed in symmetrical relation to the upper retaining members 9, the upper openings 7 and the upper wall portions 14.

A both end-supported type lock arm 17 having a lock projection 16 (FIG. 1) for a mating connector housing (not shown) is formed at the upper wall 14 of the connector housing 2. A pair of guide rails 18 (FIG. 1) are formed at each of the upper and lower walls 14, and are disposed respectively at opposite (left and right) sides of the lock arm 17, and also another pair of guide rails 18 are formed respectively at left and right ends of each of the upper and lower walls 14 of the connector housing 2. These guide rails 18 serve to guide the sliding movement of the front holder 3. The upper retaining members 9, as well as the lower retaining members 9, are disposed respectively at the opposite (left and right) sides of the lock arm 17. The connector housing 2 has front ports 5*a* (FIG. 1) of the terminal receiving chambers 5 formed in a front end wall 19 thereof, and also has rear ports 5*b* formed in a rear end wall 20 (FIG. 2) thereof.

The front holder 3 has a generally U-shape defined by a vertical front wall 21 and a pair of upper and lower horizontal walls 22. Male terminal-inserting rectangular holes 23 for communicating respectively with the front ports 5*a* of the terminal receiving chambers 5 of the connector housing 2 are formed through the front end wall 21. A tapering guide surface 23*a* is formed at a peripheral edge of each hole 23 so as to smoothly guide a male terminal of the mating connector (not shown) into the hole 23.

A rectangular notch 24 is formed in a widthwise-central portion of each of the upper and lower walls 22 of the front holder 3 in a manner to avoid the lock arm 17. Opposed side edge portions of each notch 24 and left and right ends of each of upper and lower walls 22 serve as sliding engagement portions 25 for the guide rails 18.

Projecting walls 27 are formed integrally at a rear end of each of the upper and lower walls 22 of the front holder 3, and each projecting wall 27 has a first slanting surface (slanting portion) 26 for pushing the corresponding retaining member 9 into the connector housing 2 to achieve the provisional retaining (the primary pushing-in). The upper projecting walls 27, as well as the lower projecting walls 27, are disposed respectively at opposite sides of the notch 24 so as to correspond to the corresponding terminal receiving chambers 5.

Each projecting wall 27 includes a plate portion 27*a* spaced from an outer surface of the corresponding (upper or lower) wall 22 of the front holder 3 in parallel relation thereto, and a plurality of ribs 27*b* interconnecting the plate portion 27*a* and the wall 22. A slanting surface 26 is formed at front ends of the plate portion 27*a* and the ribs 27*b*, and also the slanting surface 26 is formed at rear ends of the plate portion 27*a* and the ribs 27*b* (In case the slanting surface 26 is formed at least at the rear ends, this is sufficient.). The slanting surface 26 at the rear ends projects rearwardly from the wall 22. The slanting surface 26 at the rear ends faces generally inwardly (The slanting surface 26 of each upper projecting wall 27 faces generally downwardly, and the slanting surface 26 of each lower projecting wall 27 faces generally upwardly.).

Ribs 28 are formed on an inner surface of each of the upper and lower walls 22 of the front holder 3, and extend in the forward-rearward direction. Rear ends of the ribs 28 are disposed slightly forwardly of the rear end of the wall 22, and the rear ends of the ribs 28 define a second (discontinuous) slanting surface (slanting portion) 29 for further pushing the retaining member 9 from the provisionally-retained condition into a completely-retained condition (to achieve the secondary pushing-in). The angle of the second slanting surface 29 relative to a horizontal plane is a little larger than the angle of the first slanting surface 26.

Provisionally-retaining means and completely-retaining means for the connector housing 2 are provided at an inner surface of the front end wall 21 of the front holder 3. These retaining means are formed by arm portions 30 (FIG. 2) and projections 31 formed at distal ends of these arm portions 30. The connector housing 2 has engagement portions (not shown) for engagement with these projections 31. These retaining means are of a known construction.

Plate-like or pin-like protruding portions 32 for insertion into the bending spaces 13 (FIG. 4) for the first retaining lances 6 are also formed on the inner surface of the front end wall 21 of the front holder 3. These protruding portions 32 perform both the function of preventing the bending of the retaining lances 6 and the function of detecting a terminal incompletely-inserted condition.

Figure 3:
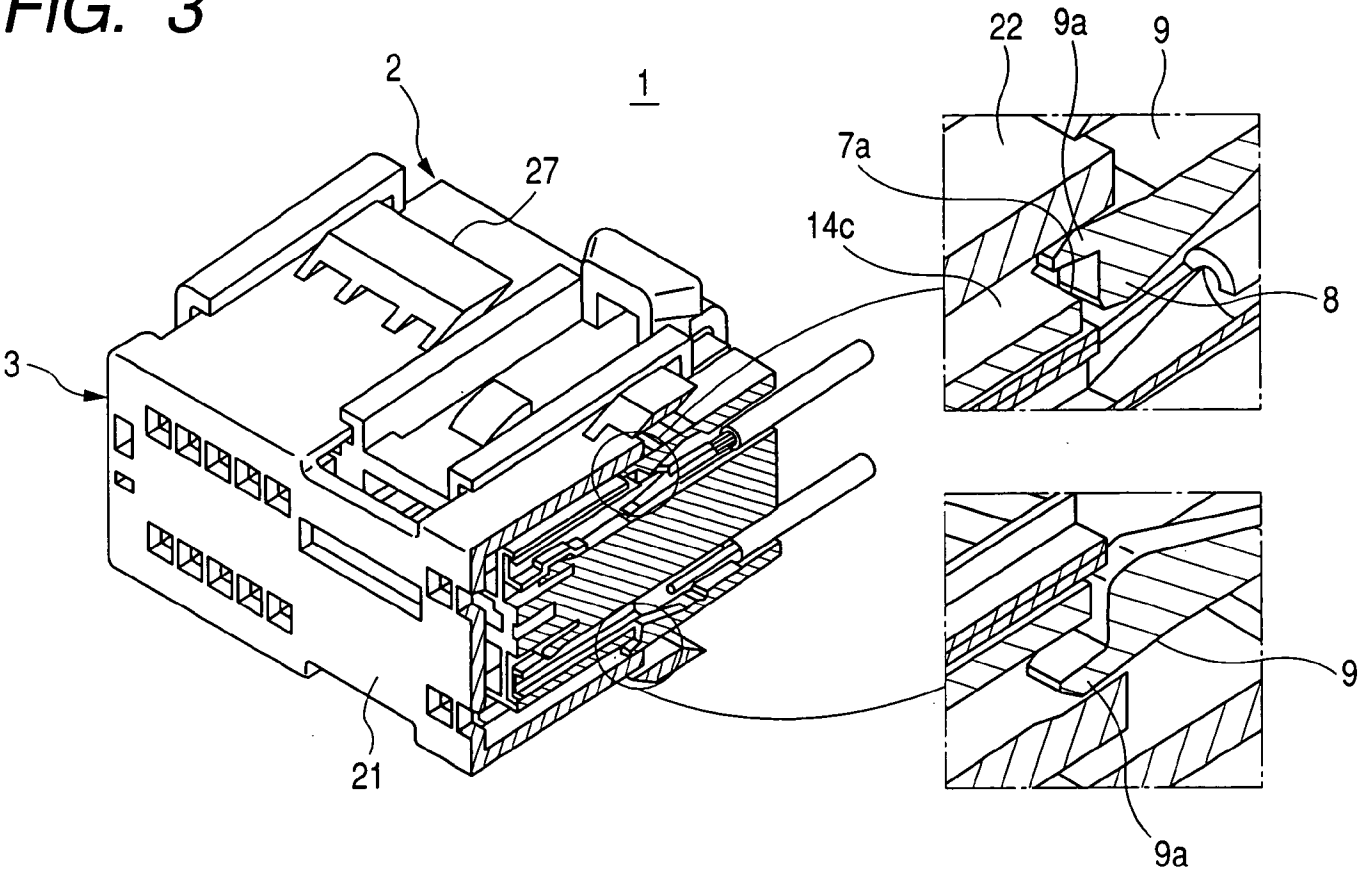
FIG. 3 is a perspective view of the connector, showing a condition in which terminals are primarily retained (Square portions are enlarged views of important portions.).
Figure 4:
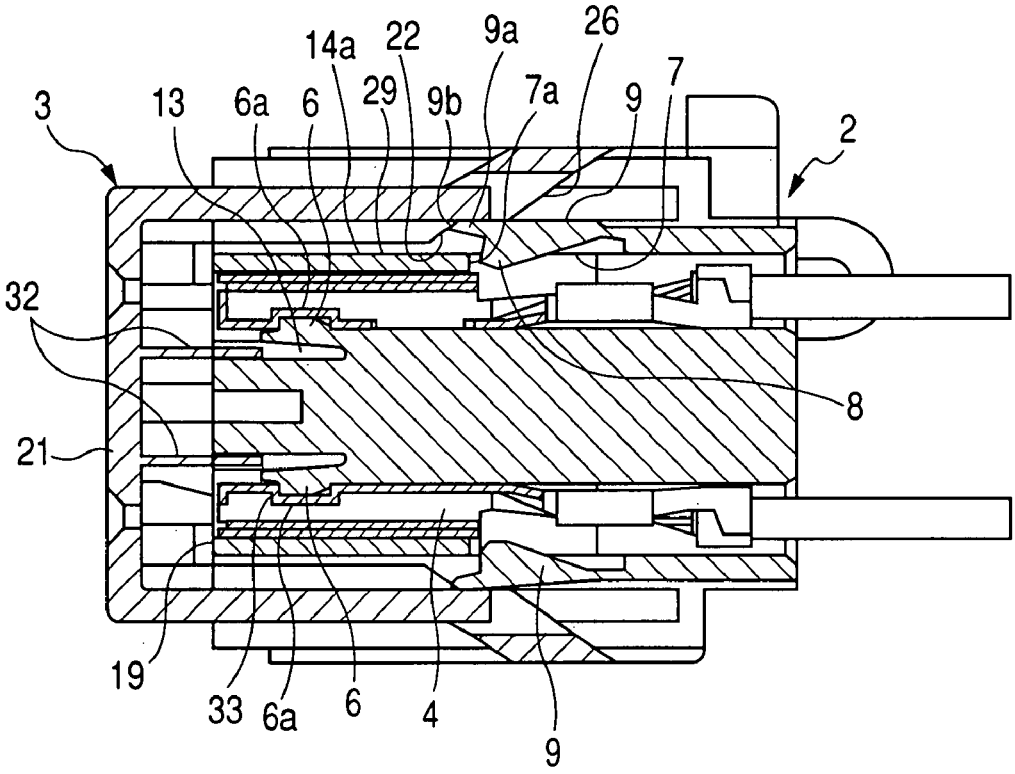
FIG. 4 is a vertical cross-sectional view of the connector, showing the primarily retained condition of the terminals.

FIGS. 3 and 4 show the provisionally-retained condition of the retaining members 9. The front holder 3 is provisionally retained (provisionally attached) relative to the connector housing 2 by the provisionally-retaining means, and in this condition the front holder 3 is projected slightly forwardly with a gap formed between the two front end walls 19 and 21 (FIG. 4).

The front holder 3 is attached in a sliding manner to the connector housing 2, and the front end portions (distal end portions) 9*a* of the upper and lower retaining members 19 are inwardly pressed by the respective first slanting surfaces 26 formed at the rear end of the front holder 3, and are simultaneously introduced into the openings 7 in the connector housing 2. Also, the front holder 3 is slid slightly rearward (in the pushing direction), and the thin front end portions 9*a* of the retaining members 9 come into contact with the inner surfaces of the upper and lower walls 22 of the front holder 3, and slanting front end surfaces 9*b* of the retaining members 9 are brought into abutting engagement with the respective second slanting surfaces 29. Each projection 8 of each retaining member 9 is disposed in opposed relation to a front end 7*a* of the corresponding opening 7 in the front half wall portion 14*a* of the connector housing 2. Thus, the operations for provisionally retaining the plurality of (upper and lower) retaining members 9 are efficiently carried out at the same time by the respective projecting walls 27 of the front holder 3.

Through the abutting engagement of the second slanting surfaces 29 with the front end portions 9*a* of the respective retaining members 9, the worker can recognize the completion of the provisionally-retaining operation of the front holder 3. And, the front holder 3 will not be slid in the completely-retaining (completely-attaching) direction unless the front holder 3 is intentionally pushed rearward, and therefore the worker can positively effect the provisionally-retaining operation of the front holder 3 and the next completely-retaining operation (an operation for retaining the terminals 4 in a double manner).

In the provisionally-retained condition of each retaining member 9, the female terminals 4 are inserted into the connector housing 2 from the rear side thereof, and are primarily retained by the respective first retaining lances 6. Namely, the projection 6*a* of each retaining lance 6 is engaged in a recess 33 formed in an intermediate portion of an electrical contact portion (having a square tubular shape) of the female terminal 4. The protruding portions 32 of the front holder 3 are disposed adjacent to inlets of the bending spaces 13 for the retaining lances 6, that is, disposed slightly forwardly of the front ends of the retaining lances 6. If any of the female terminals 4 should be incompletely inserted (half inserted), the corresponding retaining lance 6 is pressed by the electrical contact portion of this terminal 4, and therefore is kept in a bent condition.

Figure 5:
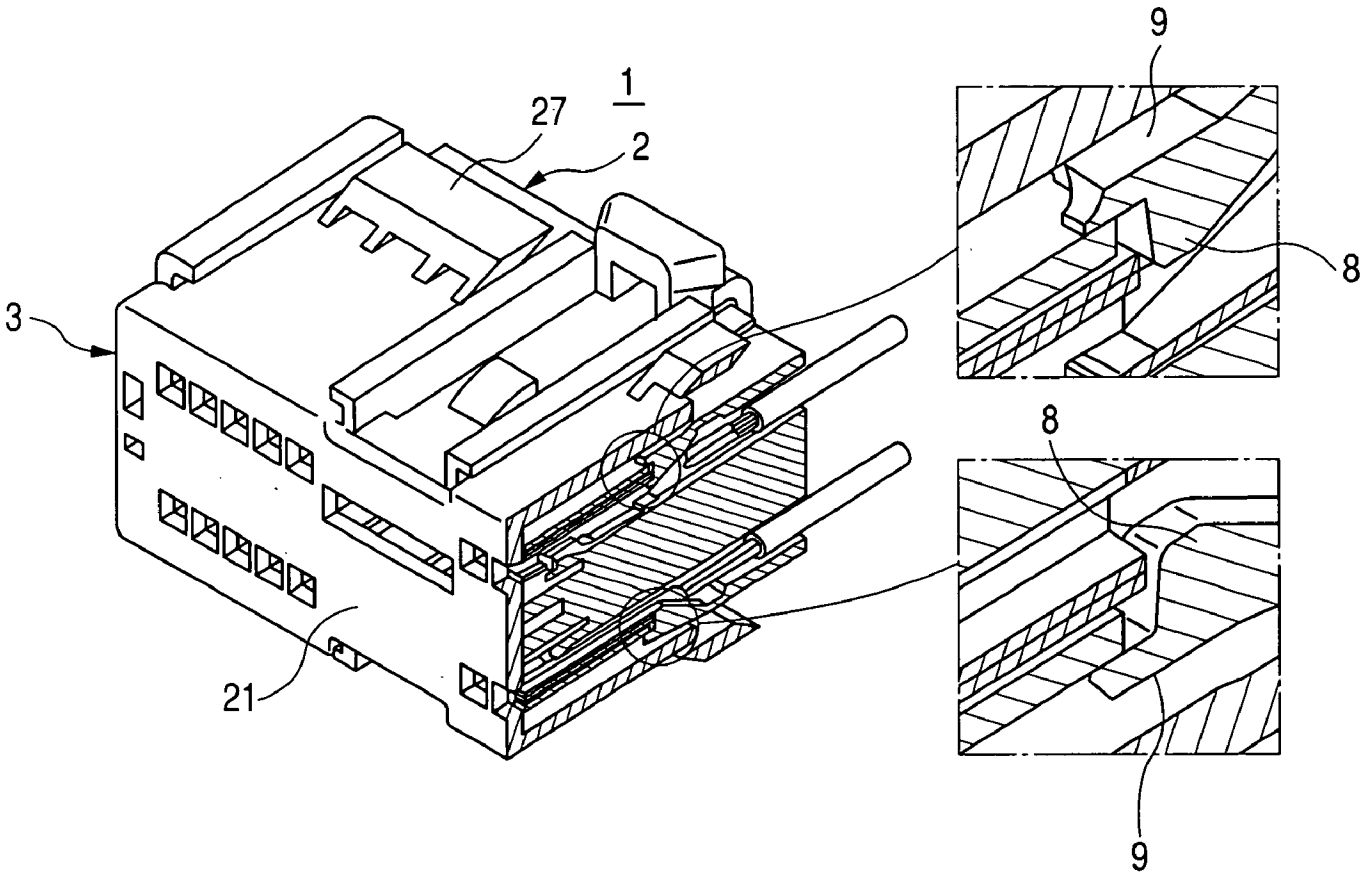
FIG. 5 is a perspective view of the connector, showing a condition in which the terminals are retained in a secondary manner (Square portions are enlarged view of important portions.).
Figure 6:
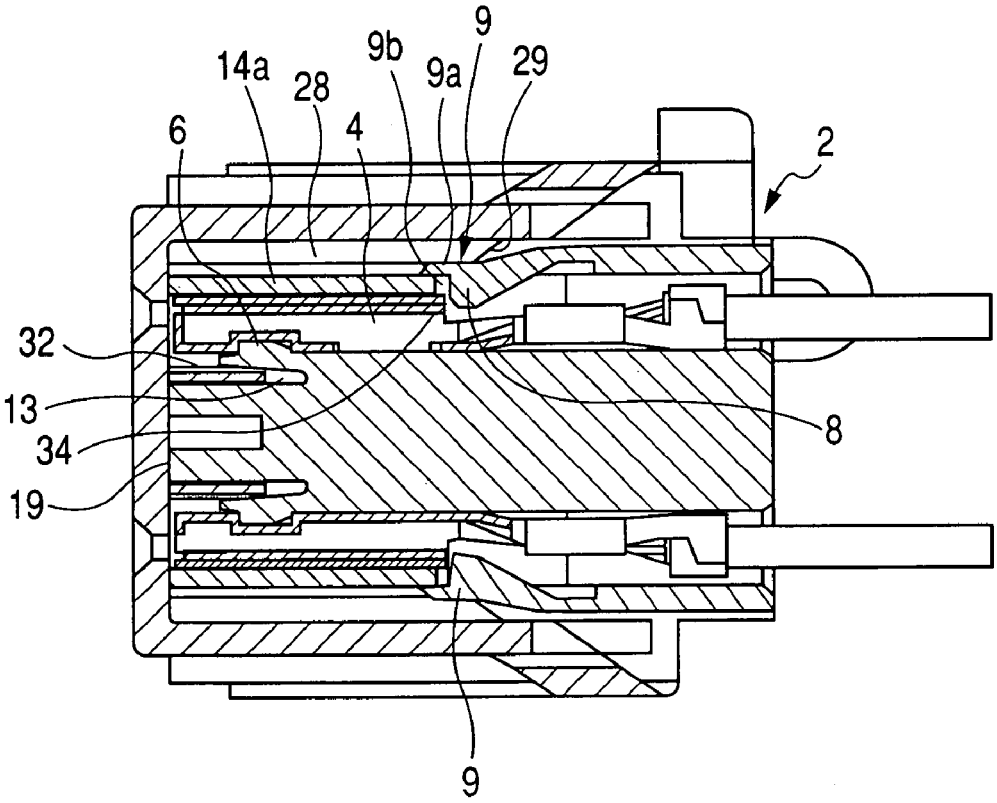
FIG. 6 a vertical cross-sectional view of the connector, showing the secondarily-retained condition of the terminals.

FIGS. 5 and 6 show the completely-retained condition of the retaining members 9, that is, the secondarily (double) retained condition of the female terminals 4. The front holder 3 is completely retained relative to the connector housing 2 by the completely-retaining means, with the two front end walls 19 and 21 held in close contact with each other.

Each retaining member 9 slides forward past the second slanting surface 29 of the front holder 3 (The slanting surface 9 slides rearward past the front end surface 9*b* of the retaining member 9), and the thin front end portion 9*a* of the retaining member 9 is held between the ribs (wall portion) 28 and the front half wall portion 14*a* of the connector housing 2, and the projections 8 of the retaining member 9 retain rear step portions 34 of the respective terminals 4 in a secondary manner. Thus, the operations for completely retaining the upper and lower retaining members 9 and the secondary retaining of the terminals 4 are efficiently carried out at the same time.

The protruding portions 32 of the front holder 3 are inserted respectively into the bending spaces 13 for the retaining lances 6, thereby preventing the bending of the retaining lances 6. As a result, each female terminal 4 is retained in a triple manner by the retaining lance 6, the protruding portion 32 (for the purpose of preventing the bending of the lance) and the retaining member 9, so that the retaining force is markedly increased.

And besides, each retaining member 9 is so constructed as to be elastically bent while being brought into abutting engagement with the first slanting surface 26 and the second slanting surface 29 in stages, and therefore the amount of bending of the retaining member 9 is determined in stages by the slanting surfaces 26 and 29, and a feel of a resistance is clearly obtained when sliding the front holder 3 in the pushing direction so as to achieve each of the provisionally-retained condition and the completely-retained condition of the retaining members 9. Therefore, the provisionally-retaining operation as well as the completely-retaining operation can be positively effected with a good click feel.

In FIGS. 3 and 4, if any of the terminals 4 is in an incompletely-inserted condition, the corresponding protruding portion 32 abuts against the front end of the elastically-bent retaining lance 6, and the front holder 3 can not be pushed any further, so that the abnormal insertion of the terminal is detected. When the terminal 4 is incompletely inserted, the projection 8 of the retaining member 9 also abuts against the electrical contact portion of this terminal 4, so that the retaining member 9 can not be completely retained, and therefore the front holder 3 can not be pushed rearward, so that the abnormal insertion of the terminal is detected in a double manner.

For withdrawing the terminal 4 from the connector housing, the completely-retained condition of the front holder 3 is canceled, and the front holder 3 is withdrawn forward, and is provisionally retained, and the retaining of the terminal 4 by the retaining lance 6 is canceled using a bar-like jig (not shown), and the terminal 4 is withdrawn. In the provisionally-retained condition of the front holder 3, the retaining members 9 are held against the respective (upper and lower) walls 22 of the front holder 3 as shown in FIG. 4, and therefore the completely-retaining operation after the insertion of a terminal can be effected easily.

In the first embodiment, even in the case where the protruding portions 32 for double retaining purposes and incomplete insertion confirmation purposes are not provided, the terminals 4 are positively retained by the double retaining members 9 with the high retaining force, and therefore this construction is also sufficient for practical use.

FIGS. 7 to 10 show a second embodiment of a connector of the invention.

Figure 7:
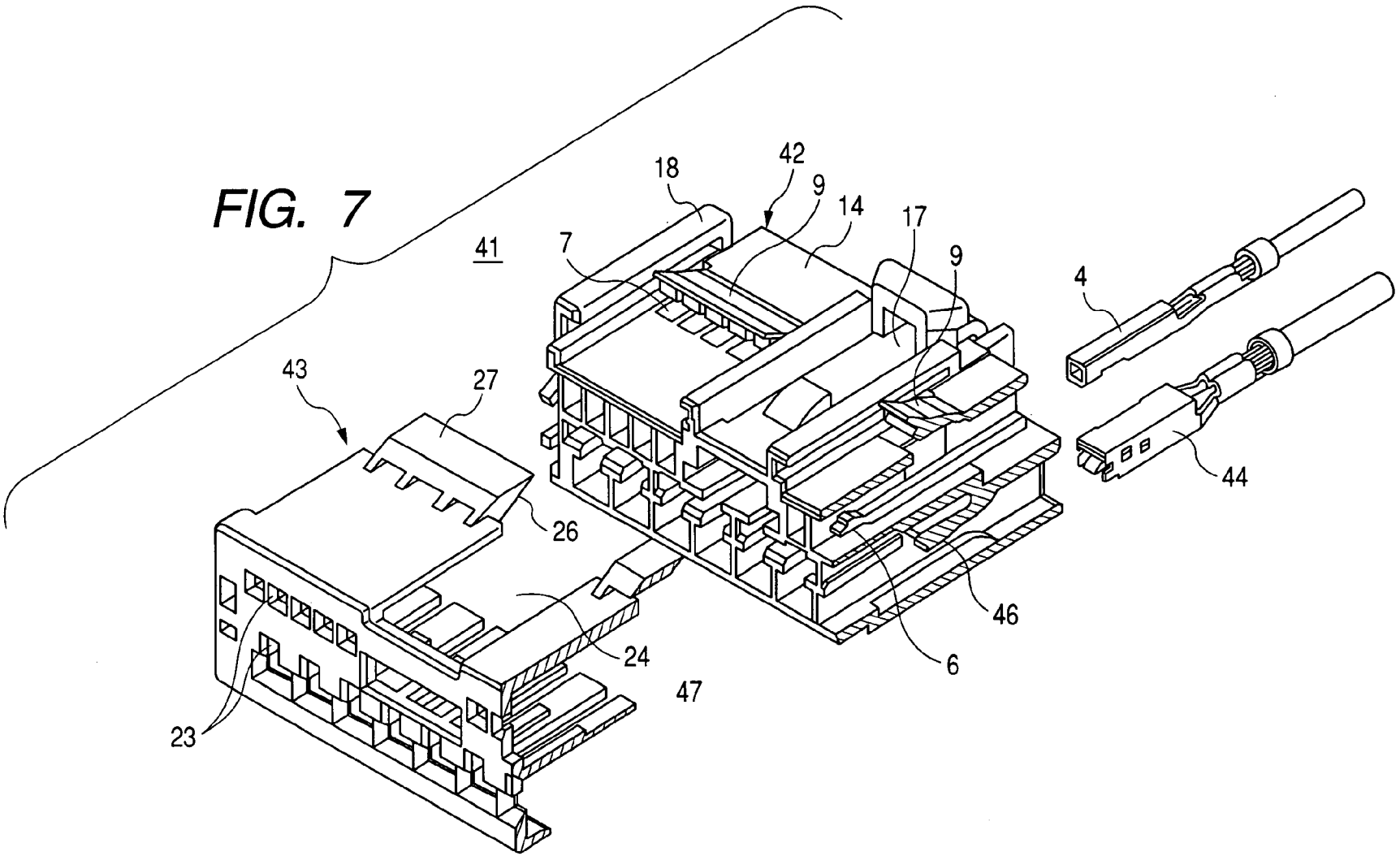
FIG. 7 is an exploded perspective view of a second embodiment of a connector of the invention.
Figure 8:
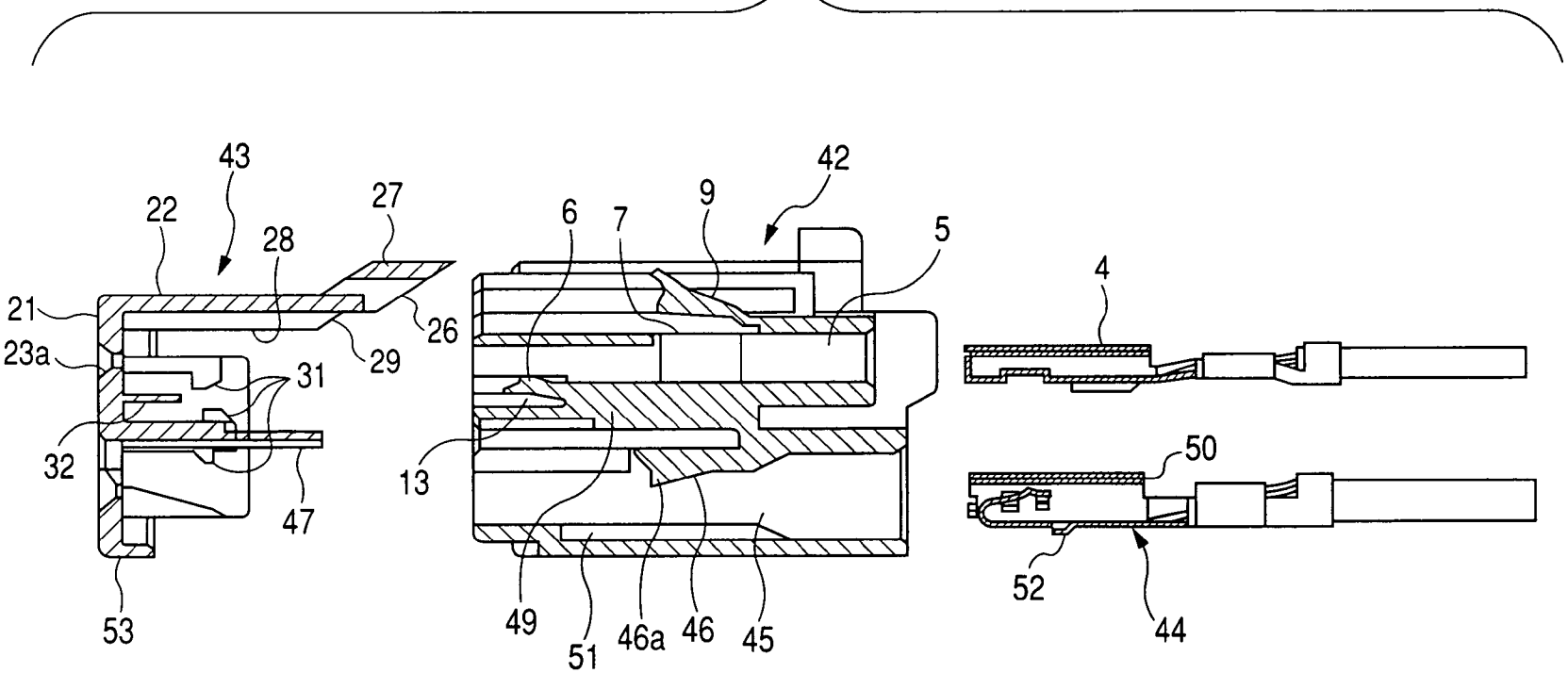
FIG. 8 is an exploded, vertical cross-sectional view of the connector of FIG. 7.

As shown in FIGS. 7 and 8, in this connector 41, a plurality of kinds (two kinds in this embodiment) of female terminals 4 and 44 (each having a wire connected thereto) are received within a synthetic resin-made connector housing 42, and are retained in a double manner by a synthetic resin-made front holder 43.

The upper female terminals 4 of a smaller size are retained in a double manner by retaining lances 6 and retaining members 9 which are similar to the retaining lances 6 and the retaining members 9 of the first embodiment. The retaining lances 6 and the retaining members 9 are similar in construction to those of the first embodiment. Those constituent portions similar to those of the first embodiment will be designated by identical reference numerals, respectively, and detailed explanation thereof will be omitted.

Figure 9:
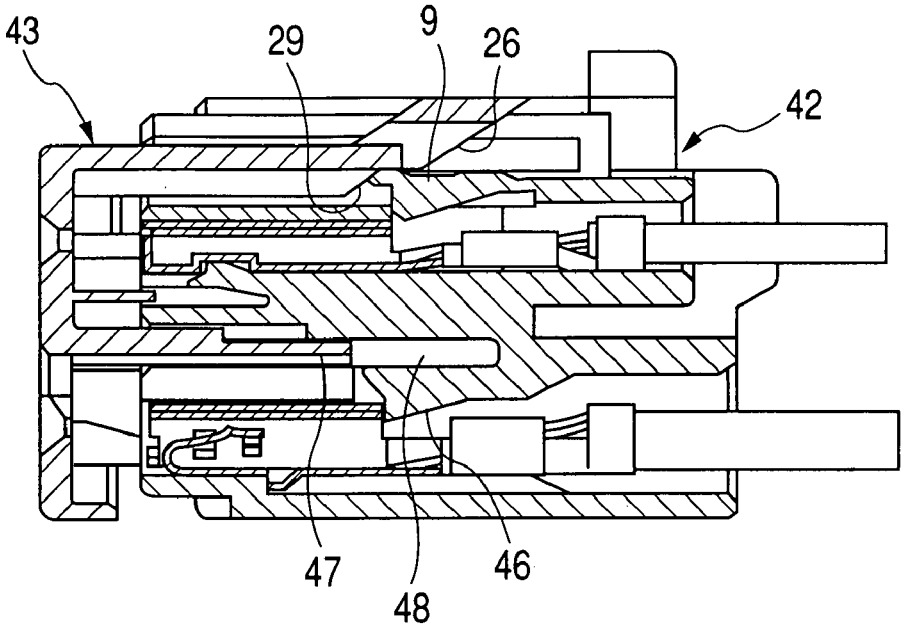
FIG. 9 is a vertical cross-sectional view of the connector of FIG. 7, showing a condition in which terminals are primarily retained.
Figure 10:
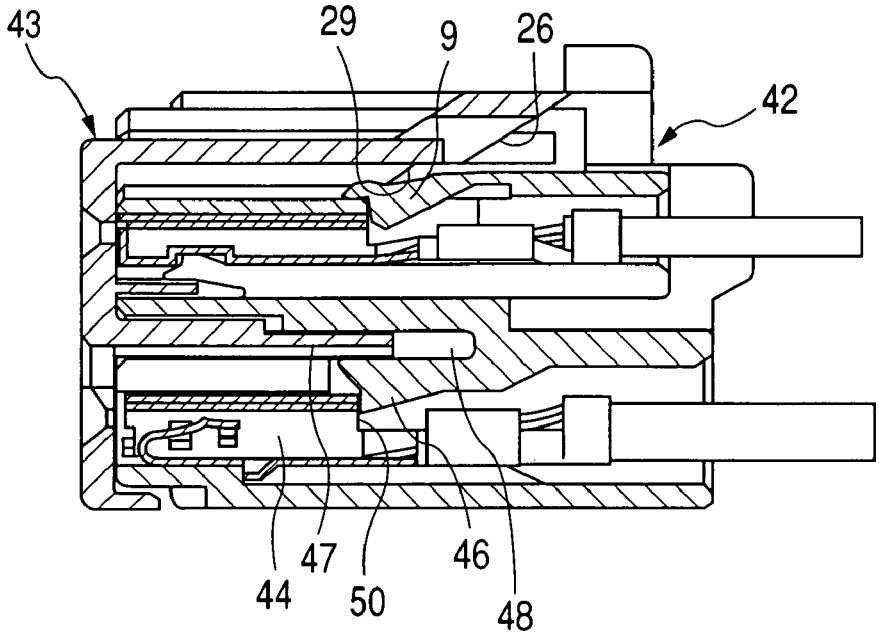
FIG. 10 is a vertical cross-sectional view of the connector of FIG. 7, showing a condition in which the terminals are retained in a secondary manner.

The lower female terminals (another kind of terminals) of a larger size are retained in a double manner by another kind of elastic retaining lances 46 of a larger size (provided respectively in terminal receiving chambers 45 of the connector housing 42) and another kind of plate-like or pin-like protruding portions 47 of the front holder 43. When the front holder 43 is provisionally retained as shown in FIG. 9, the protruding portions 47 are disposed slightly forwardly of respective bending spaces 48 for the retaining lances 46. When the front holder 43 is completely retained as shown in FIG. 10, the protruding portions 47 are inserted respectively into the respective bending spaces 48 for the retaining lances 46 to prevent the bending of the retaining lances 46, thus performing a high terminal retaining force.

Each lower retaining lance 46 is provided at a generally central portion of the corresponding terminal receiving chamber 45 (FIG. 8) in a downwardly-facing manner, and has a downwardly-directed projection 46*a*. The lower retaining lances 46 are formed integrally on a partition wall 49 separating upper terminal receiving chambers 5 of the connector housing 42 from the lower terminal receiving chambers 45. The upper smaller retaining lances 6 are disposed forwardly of the lower larger retaining lances 46. The upper smaller female terminals 4 and the lower larger female terminals 44 are inserted in the respective terminal receiving chambers 5 and 45 not in face-to-face relation but in the same posture. Each lower female terminal 44 is retained at a rear step portion 50 of its electrical contact portion of a rectangular tubular shape by the retaining lance 46 as shown in FIG. 10.

In FIGS. 7 and 8, reference numeral 26 denotes a first slanting surface (slanting portion) of a projecting wall 27, reference numeral 29 denotes a second slanting surface (slanting portion) of ribs 28, reference numeral 31 denotes provisionally-retaining means and completely-retaining means, reference numeral 32 denotes a protruding portion for insertion into a bending space 13 for the upper retaining lance 6, and reference numeral 51 denotes a guide groove for receiving a projection 52 of the lower female terminal 44.

The front holder 43 includes a long upper wall 22, a short lower wall 53 and short left and right side walls 53. The front holder 43, when completely retained as shown in FIG. 10, is engaged with an outer surface of a front end portion of the connector housing 42. A plurality of holes 23 each for the insertion of a mating male terminal thereinto are formed through a front end wall 21 of the front holder 43, and a tapering guide surface 23*a* is formed at a peripheral edge of each hole 23 so as to smoothly guide the male terminal (not shown) of a mating connector into the hole 23.

If any of the lower female terminals 44 is incompletely inserted, the corresponding retaining lance 46 is elastically bent, and the protruding portion 47 of the front holder 43 abuts at its rear end (distal end) against the front end of the retaining lance 46, and the front holder 43 can not be pushed any further, so that the abnormal insertion of the terminal 44 is detected. This is the same with the upper terminals 4. Even in the case where the provision of the protruding portions 32 for the upper terminals 44 is omitted, each terminal 4 is retained in a double manner by the retaining lance 6 and the retaining member 9, and therefore a sufficient terminal retaining force is secured.

The second embodiment can be modified into a construction in which upper and lower terminals 4 and 44 of different kinds are received in the connector housing in back-to-back relation, and in this case an intermediate portion of the electrical contact portion of each lower terminal 44 is retained by the retaining lance 46 as is the case with the upper terminal 4, and the rear end 50 of the electrical contact portion of the lower terminal 44 is retained by a lower retaining member (not shown) in a double manner.

In this case, each lower retaining member is provided at openings (7) in a lower wall of the connector housing (2) as described above for the first embodiment (FIG. 2), and a provisionally-retained condition and a completely-retained condition of the lower retaining member are achieved respectively by a lower first slanting surface (26) and a lower second slanting surface (29). In this case, the upper retaining members (9) and the lower retaining members (9) can be offset relative to each other in the forward-rearward direction, and also the upper and lower slanting surfaces (26), as well as the upper and lower slanting surfaces (29), can be offset relative to each other in the forward-rearward direction according to the positions of the upper and lower slanting surfaces (26 and 29).

FIGS. 11 to 14 show a third embodiment of a connector of the invention.

Figure 11:
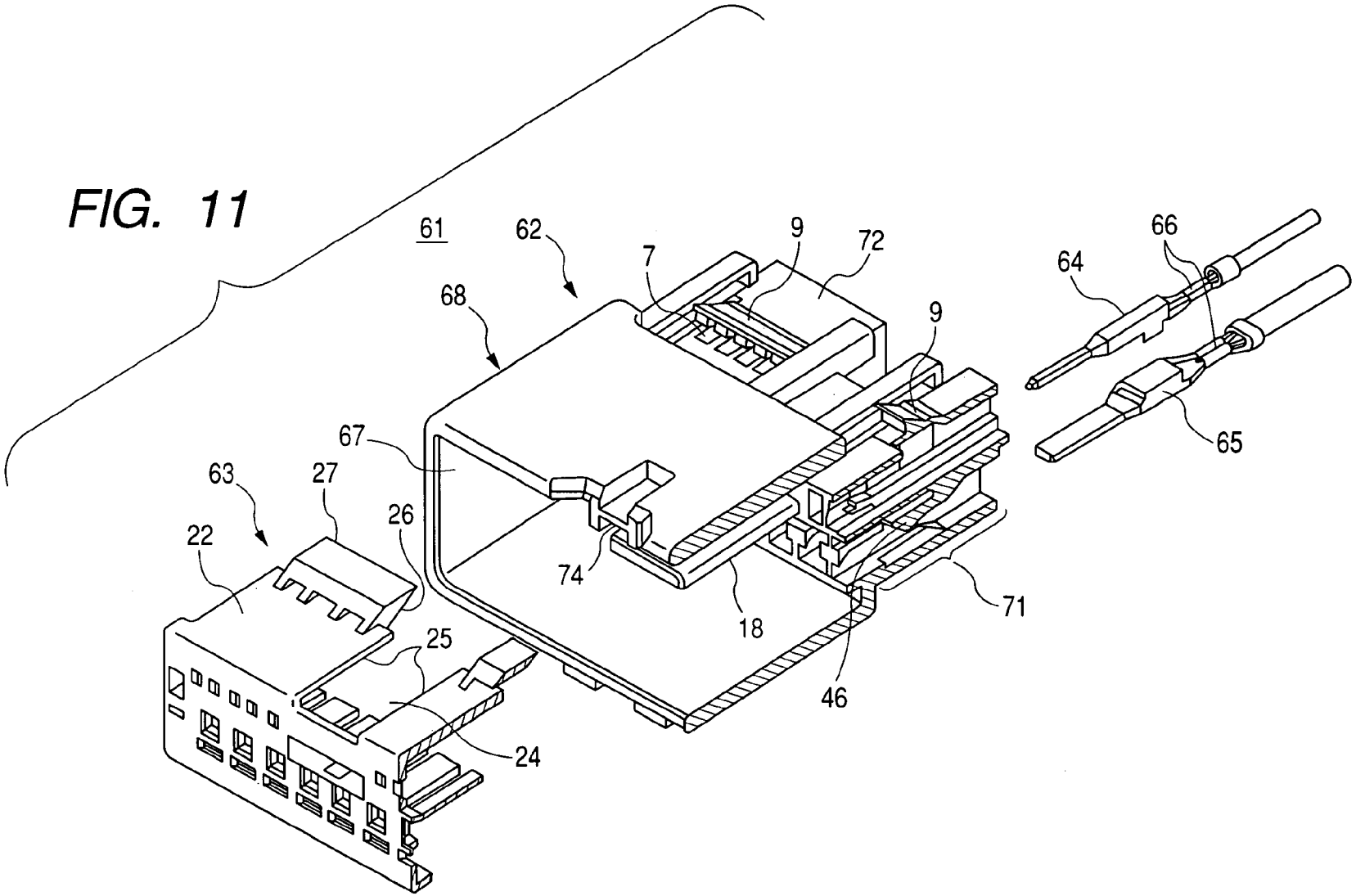
FIG. 11 is an exploded perspective view of a third embodiment of a connector of the invention.
Figure 12:
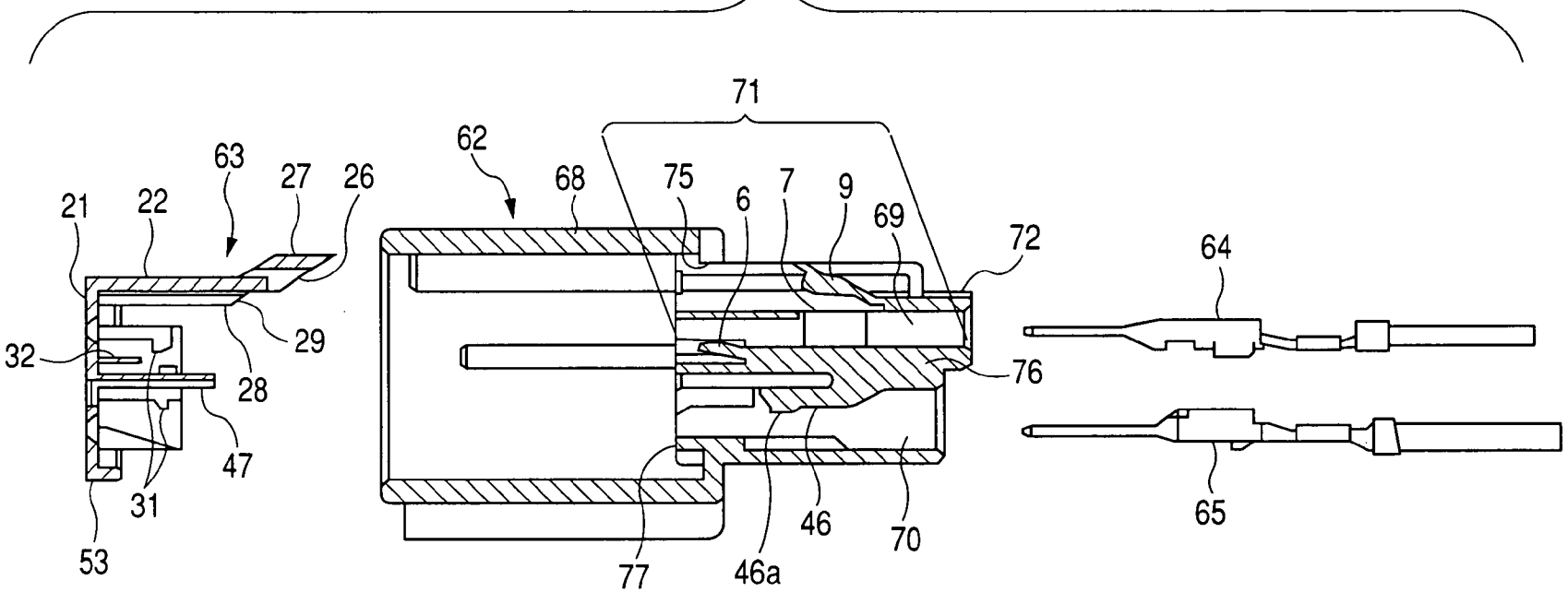
FIG. 12 is an exploded, vertical cross-sectional view of the connector of FIG. 11.

As shown in FIGS. 11 and 12, in this connector 61, different kinds of male terminals 64 and 65 each having a wire connected thereto are received in the same posture in a synthetic resin-made connector housing 62, and are arranged in two (upper and lower) rows, and these male terminals are retained in a double manner by a synthetic resin front holder 63. This connector is similar in basic structure to the connectors of the first and second embodiments, and therefore those constituent portions similar to those of the above embodiments will be designated by identical reference numerals, respectively, and detailed explanation thereof will be omitted. That the upper and lower terminals 64 and 65 are disposed in the same posture means that their wire press-clamping portions 66 face in the same direction.

The connector housing 62 includes a hood portion (peripheral wall) 68 (which is a front half portion thereof) forming a connector fitting chamber 67, and a terminal receiving portion 71 (which is a rear half portion thereof) forming upper and lower terminal receiving chambers 69 and 70. Retaining members 9 and openings 7 (in which the retaining members 9 are engageable) are provided at an upper wall 72 of the terminal receiving portion 71.

Figure 13:
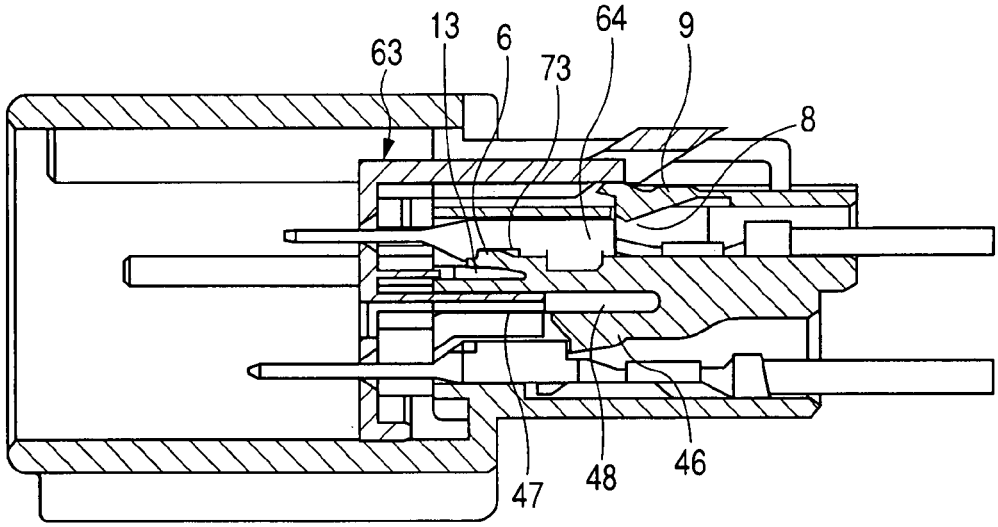
FIG. 13 is a vertical cross-sectional view of the connector of FIG. 11, showing a condition in which terminals are primarily retained.
Figure 14:
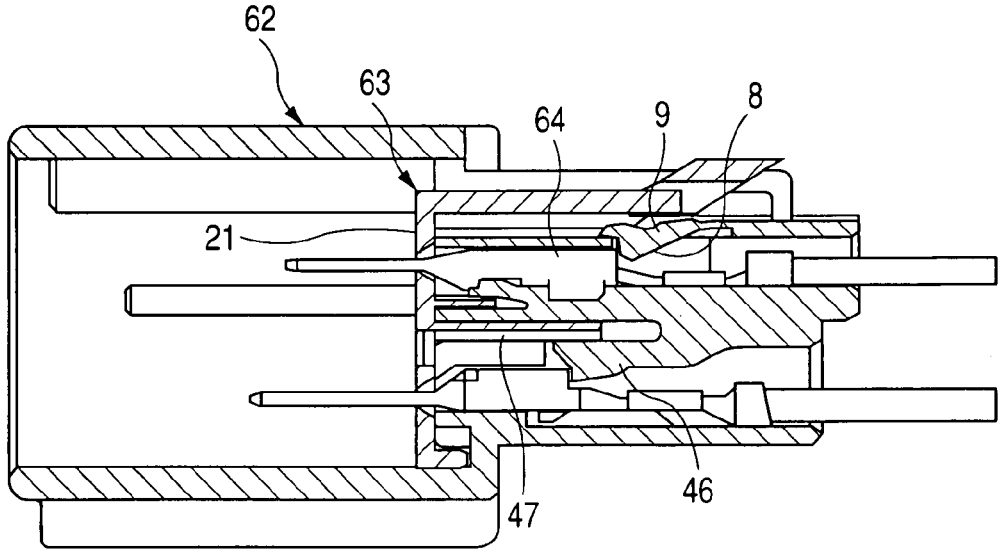
FIG. 14 is a vertical cross-sectional view of the connector of FIG. 11, showing a condition in which the terminals are retained in a secondary manner.
Figure 15:
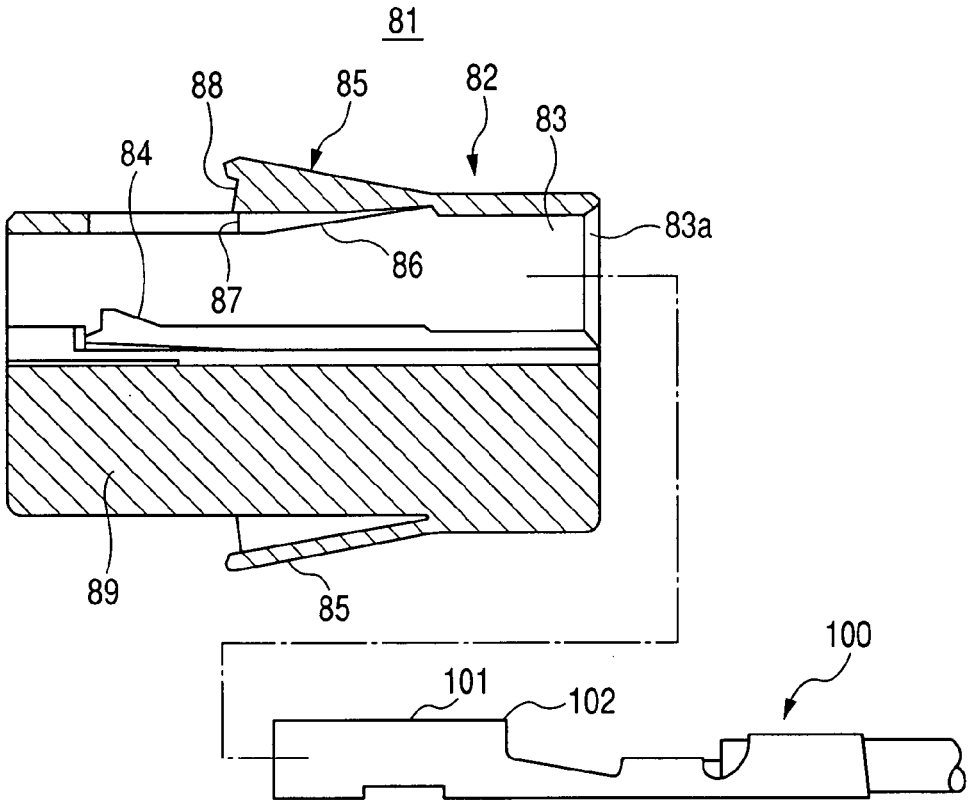
FIG. 15 is a vertical cross-sectional view of a conventional connector.
Figure 16:
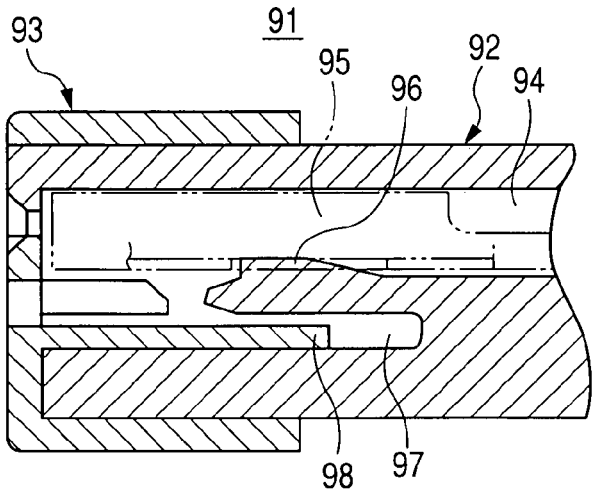
FIG. 16 is a vertical cross-sectional view of another conventional connector.

As shown in FIG. 13, each upper male terminal 64 is primarily retained by a small retaining lance 6 of the connector housing 62 which is engaged in a recess 73 formed in a barrel portion of the terminal 64 extending from a tab-like electrical contact portion thereof. As shown in FIG. 14, a rear end of the barrel portion of the male terminal 64 is retained in a secondary manner by a downwardly-directed projection 8 of the retaining member 9. FIG. 13 shows a provisionally-retained condition of the front holder 63, and FIG. 14 shows a completely-retained condition of the front holder 63.

The front holder 63 (FIG. 12) includes a vertical front end wall 21, an upper horizontal wall 22, a short lower wall 53, and short left and right walls 53. Projecting walls 27 each having a first slanting surface (slanting portion) 26 are formed at the upper wall 22, and also ribs 28 having a second (discontinuous) slanting surface (slanting portion) 29 are formed at the upper wall 22. Another kind of longer protruding portions 47 for insertion into bending spaces 48 (FIG. 13) for another kind of lower retaining lances 46, as well as shorter protruding portions 32 for insertion into bending spaces 13 (FIG. 13) for the upper retaining lances 6, are formed on an inner surface of the front end wall 21. The provision of the upper protruding portions 32 can be omitted.

A notch 24 is formed in a widthwise-central portion of the upper wall 22 of the front holder 63. Guide rails 18 are provided within the hood portion 68 of the connector housing 62, and opposed side edge portions (sliding engagement portions) 25 of the notch 24 are slidably engaged with the guide rails 18, respectively. A recess portion 74 is formed at the hood portion 68, and a lock arm 17 of a mating connector (connector 41 of the second embodiment) is engaged in this recess portion 74.

When the front holder 63 is attached to the connector housing 62, the upper wall 22 moves through the interior of the hood portion 68, and is disposed in contiguous relation to the outer surface of the upper wall 72 of the terminal receiving portion 71. An opening 75 is formed in a rear wall of the hood portion 68, and the upper wall 22 of the front holder 63 passes through this opening 75. The slanting surfaces 26 of the projecting walls 27 formed at the rear end of the upper wall 22 press the respective retaining members 9 into the terminal receiving portion 71, thereby provisionally retaining the retaining members 9 as shown in FIG. 13. In this condition, the upper and lower male terminals 64 and 65 are inserted into the terminal receiving portion 71 from a rear side thereof. In FIG. 12, reference numeral 31 denotes means for provisionally and completely retaining the front holder 63 relative to the connector housing 62.

Each lower terminal (the other kind of terminal) 65 is retained at a rear end of its barrel portion by a projection 46*a* of the downwardly-facing larger retaining lance 46 formed at a generally central portion of a horizontal partition wall 76 of the connector housing 62. When the front holder 63 is pushed rearward as shown in FIG. 14, the protruding potions 47 prevent the bending of the respective retaining lances 46, thereby retaining the terminals 65 in a double manner. The front end wall 21 abuts against a front end wall 77 (FIG. 12) of the terminal receiving portion 71 of the connector housing 62.

The bending of the lower retaining lances 46 is prevented by the respective longer protruding portions 47, and the bending of the upper retaining lances 6 is prevented by the respective shorter protruding portions 32. In the provisionally-retained condition of the front holder 63 shown in FIG. 13, if any of the male terminals 64 and 65 is incompletely inserted, the bent retaining lance 6 or 46 abuts against the protruding portion 32 or 47, and the front holder 63 can not be pushed any further, so that the abnormal insertion of this terminal is detected.

The third embodiment can be modified into a construction in which the upper terminals 64 and the lower terminals 65 are received symmetrically (in back-to-back relation or face-to-face relation) as in the first embodiment, and in this case retaining members 9 and openings 7 (similar to those of the first embodiment) are provided at the upper and lower walls 72 of the terminal receiving portion 71 of the connector housing 62, and upper and lower retaining lances 6 and 46 are formed on the horizontal intermediate partition wall 76, and the upper terminals 64 and the lower terminals 65 are retained in a double manner by first slanting surfaces 26 of projecting walls 27 of upper and lower walls 22 of the front holder 63 and second slanting surfaces 29 of ribs 28 either simultaneously or with a time lag (in the case where the upper slanting surfaces 26 and 29 are offset respectively relative to the lower slanting surfaces 26 and 29 in the forward-rearward direction).

In each of the above embodiments, two (left and right) retaining members 9 are provided at least at the upper wall 14, 72 of the connector housing 2, 42, 62, and two (left and right) first slanting surfaces 26 and two (left and right) second slanting surfaces 29 are provided at least at the upper wall 22 of the front holder 3, 43, 63, and by pushing the front holder, the retaining members are efficiently simultaneously retained provisionally and also completely. However, even in the case where only one retaining member 9 is provided at least at the upper wall of the connector housing 2, 42, 62, the retaining member can be positively retained provisionally and completely without any human mistake by pushing the front holder (which has only one first slanting surface 26 and only one second slanting surface 29).

Furthermore, in each of the above embodiments, the terminals 4, 64 are primarily retained by the retaining lances 6, and then are retained in a secondary manner by the retaining member 9. However, instead of using the retaining lances 6, there can be used, for example, a construction in which a resilient retaining piece portion (not shown) formed at each terminal is engaged in a recess portion (not shown) in the connector housing. Furthermore, in the cases where the connector has such a structure that the terminals 4, 64 will not be withdrawn (for example, the terminals are inserted in the respective terminal receiving chambers in a press-fitted manner) even if the terminals 4, 64 are not primarily retained, the terminals 4, 64 can be retained directly by the retaining member 9 without using the retaining lances 6.

Furthermore, in each of the above embodiments, the pushing-in of the retaining members 9 and the prevention of bending of the retaining lances 6, 46 are effected by the use of the front holder 3, 43, 63. However, the pushing-in of the retaining members and the prevention of bending of the retaining lances can be effected, for example, by the use of a rear holder (not shown). In this case, holes for the passage of terminals (each having a wire connected thereto) therethrough are formed through a rear vertical wall of the rear holder, and provisionally retaining-purpose first slanting surfaces and completely retaining-purpose second slanting surfaces which serve to push the retaining members into the connector housing are formed at upper and lower walls of the rear holder (The retaining member may project either forward or rearward.), and protruding portions for insertion into bending spaces for rearwardly-projecting retaining lances are formed on the vertical rear wall. The rear holder is suitably used in the case where a waterproof plug is attached to each wire connected to the terminal.

What is claimed is:

1. A connector, comprising:

a connector housing for receiving terminals;

a holder attached in a sliding manner to said connector housing;

a terminal retaining member pivotally provided at an opening portion of said connector housing;

wherein said holder includes:

a first slanting portion for pushing said terminal retaining member into said opening portion so as to provisionally retain said terminal retaining member; and a second slanting portion for pushing said terminal retaining member into said opening portion so as to completely retain said terminal retaining member.

2. The connector according to claim 1, wherein when said retaining member is provisionally retained, a distal end of said retaining member abuts against said second slanting portion.

3. The connector according to claim 1, wherein when said retaining member is provisionally retained, a wall of said holder is disposed in contact with an outer surface of a distal end portion of said retaining member.

4. The connector according to claim 1, wherein the distal end portion of said retaining member is held between a wall of a connector housing and a wall of said holder.

5. The connector according to claim 1, wherein:

a plurality of said retaining members are provided; and a plurality of said first slanting portions and a plurality of said second slanting portions are respectively provided in corresponding relation to said plurality of retaining members.

6. The connector according to claim 1, wherein said holder has protruding portions for insertion into respective bending spaces for terminal primarily-retaining lances provided within said connector housing.

7. The connector according to claim 1, wherein:

another kind of terminals are retained respectively by another kind of retaining lances provided within said connector housing; and another kind of protruding portions of said holder prevent the bending of said another kind of retaining lances.

* * * * *